US008490223B2

(12) United States Patent
Gell, III

(10) Patent No.: US 8,490,223 B2
(45) Date of Patent: Jul. 23, 2013

(54) TOILET WITH BALL VALVE MECHANISM AND SECONDARY AEROBIC CHAMBER

(75) Inventor: William A. Gell, III, Danvers, MA (US)

(73) Assignee: Flow Control LLC, Gloucester, MA (US)

( * ) Notice: Subject to any disclaimer, the term of this patent is extended or adjusted under 35 U.S.C. 154(b) by 0 days.

(21) Appl. No.: 13/587,392

(22) Filed: Aug. 16, 2012

(65) Prior Publication Data

US 2013/0055498 A1 Mar. 7, 2013

Related U.S. Application Data

(60) Provisional application No. 61/524,120, filed on Aug. 16, 2011.

(51) Int. Cl.
*E03D 11/10* (2006.01)

(52) U.S. Cl.
USPC ..... 4/434; 4/438; 4/441

(58) Field of Classification Search
USPC ..... 4/431, 434, 438, 441
See application file for complete search history.

(56) References Cited

U.S. PATENT DOCUMENTS

| | | | |
|---|---|---|---|
| 310,972 | A | 1/1885 | Apel |
| 965,400 | A | 7/1910 | McPherson |
| 1,629,401 | A | 5/1927 | McCall |
| 1,779,642 | A | 10/1930 | Schumacher |
| 2,204,704 | A | 6/1940 | Schumacher |
| 2,258,454 | A | 10/1941 | Johnson |
| 2,675,562 | A | 4/1954 | Duner |
| 3,883,903 | A | 5/1975 | Vanden Broek et al. |
| 3,932,901 | A | 1/1976 | Inui et al. |
| 4,091,475 | A | 5/1978 | Hewson et al. |
| 4,246,666 | A | 1/1981 | Stansbury, Jr. |
| 4,333,185 | A | 6/1982 | Heinze et al. |
| 4,672,689 | A | 6/1987 | Heinze et al. |
| 4,672,690 | A | 6/1987 | Sigler |
| 4,710,988 | A | 12/1987 | Stewart |
| 4,776,631 | A | 10/1988 | Sargent et al. |
| 4,819,279 | A | 4/1989 | Sigler et al. |
| 4,854,827 | A | 8/1989 | McKiernan et al. |

(Continued)

FOREIGN PATENT DOCUMENTS

| | | |
|---|---|---|
| AU | 2144988 | 3/1989 |
| AU | 598957 | 4/1989 |

(Continued)

OTHER PUBLICATIONS

English language abstract of CN 201424698 (1 page).

(Continued)

*Primary Examiner* — Tuan N Nguyen

(57) ABSTRACT

A toilet includes a bowl with a receptacle to receive waste, with a secondary chamber, and with an opening in the receptacle to allow the waste to pass to the secondary chamber; a rinse pump that turns on to add an amount of rinsing water for cleaning the bowl; a flexible self cleaning gasket configured around the opening formed in the receptacle; a bowl valve that has a sealing part having a rounded shape, rotates to a closed position that creates a sealed effect between the sealing part and the gasket trapping the waste and rinsing water in the receptacle of the bowl and sealing odors in the secondary chamber, and also rotates to an open position that sweeps the sealing part to be swept across the gasket and allowing the waste to pass to the secondary chamber. The solenoid rotates the bowl valve between the closed to open positions.

11 Claims, 2 Drawing Sheets

U.S. PATENT DOCUMENTS

| | | | |
|---|---|---|---|
| 4,893,720 | A | 1/1990 | McKiernan et al. |
| 4,947,492 | A | 8/1990 | Vincent |
| 5,139,655 | A | 8/1992 | Sigler |
| 5,214,807 | A | 6/1993 | Terve |
| 5,345,618 | A | 9/1994 | Sigler et al. |
| 5,408,704 | A | 4/1995 | Bailey et al. |
| 5,432,958 | A | 7/1995 | Bochmann et al. |
| 5,495,626 | A | 3/1996 | Lindroos et al. |
| 5,621,924 | A | 4/1997 | Friedman et al. |
| 5,644,802 | A | 7/1997 | Olin |
| 5,678,597 | A | 10/1997 | Tuomela et al. |
| 5,681,148 | A | 10/1997 | Friedman et al. |
| 5,813,061 | A | 9/1998 | Tornqist |
| 5,873,135 | A | 2/1999 | Tornqvist |
| 5,909,968 | A | 6/1999 | Olin et al. |
| 5,931,642 | A | 8/1999 | Friedman et al. |
| 5,947,146 | A | 9/1999 | Bailey et al. |
| 5,971,005 | A | 10/1999 | McKiernan et al. |
| 5,983,414 | A | 11/1999 | Lindroos et al. |
| 5,996,136 | A | 12/1999 | LaTrobe |
| 6,006,373 | A | 12/1999 | Hoang |
| 6,065,493 | A | 5/2000 | Friedman et al. |
| 6,082,979 | A | 7/2000 | Friedman |
| 6,085,366 | A | 7/2000 | Pondelick et al. |
| 6,212,700 | B1 | 4/2001 | Giesler et al. |
| 6,216,285 | B1 | 4/2001 | Olin |
| 6,234,197 | B1 | 5/2001 | McKiernan et al. |
| 6,243,887 | B1 | 6/2001 | Palffy et al. |
| 6,256,802 | B1 | 7/2001 | Stradinger |
| 6,332,229 | B1 | 12/2001 | O'Malley et al. |
| 6,347,416 | B1 | 2/2002 | Anderson et al. |
| 6,349,424 | B1 | 2/2002 | Stradinger et al. |
| 6,349,425 | B1 | 2/2002 | Stradinger et al. |
| 6,353,942 | B1 | 3/2002 | Pondelick et al. |
| 6,370,709 | B1 | 4/2002 | Stradinger et al. |
| 6,374,431 | B1 | 4/2002 | Dahlberg |
| 6,385,789 | B1 | 5/2002 | Pondelick et al. |
| 6,397,407 | B1 | 6/2002 | Dahlberg |
| 6,434,759 | B1 | 8/2002 | Pondelick et al. |
| 6,453,481 | B1 | 9/2002 | Pondelick et al. |
| 6,536,054 | B2 | 3/2003 | Anderson et al. |
| 6,536,055 | B2 | 3/2003 | Pondelick et al. |
| 6,618,866 | B1 | 9/2003 | Edmondson |
| 6,648,002 | B2 | 11/2003 | Lappalainen |
| 6,704,947 | B2 | 3/2004 | Stradinger et al. |
| 6,732,386 | B2 | 5/2004 | Anderson et al. |
| 6,782,563 | B2 | 8/2004 | Edmondson |
| 6,883,188 | B2 | 4/2005 | Sigler et al. |
| 6,957,450 | B2 | 10/2005 | Sigler et al. |
| 7,402,241 | B2 | 7/2008 | Wright et al. |
| 7,770,241 | B2 | 8/2010 | Lappalainen et al. |
| 7,845,028 | B2 | 12/2010 | Lindroos |
| 7,861,331 | B2 | 1/2011 | Grech et al. |
| 2002/0062519 | A1 | 5/2002 | Anderson et al. |
| 2002/0069459 | A1 | 6/2002 | Pondelick et al. |
| 2002/0120982 | A1 | 9/2002 | Stradinger et al. |
| 2005/0015872 | A1 | 1/2005 | Sigler et al. |

FOREIGN PATENT DOCUMENTS

| | | |
|---|---|---|
| AU | 2281688 | 4/1989 |
| AU | 673943 | 3/1995 |
| AU | 7283394 | 3/1995 |
| CA | 2209364 | 1/1998 |
| CA | 2198178 | 8/1998 |
| CA | 2372483 | 9/2002 |
| CN | 2780865 | 5/2006 |
| CN | 201047105 | 4/2008 |
| CN | 201343774 | 11/2009 |
| CN | 201424698 | 3/2010 |
| CN | 101845847 | 9/2010 |
| DE | 361635 | 8/1990 |
| DE | 4413493 | 10/1994 |
| DE | 643176 | 12/1995 |
| DE | 861981 | 5/1999 |
| DE | 69426661 | 8/2001 |
| DE | 69710175 | 9/2002 |
| DE | 20120168 | 4/2003 |
| DE | 69721722 | 3/2004 |
| DE | 20301649 | 6/2004 |
| DE | 69633014 | 7/2005 |
| DE | 60110280 | 3/2006 |
| EP | 0312784 | 4/1989 |
| EP | 0313786 | 5/1989 |
| EP | 0361635 | 4/1990 |
| EP | 0515134 | 11/1992 |
| EP | 0555984 | 8/1993 |
| EP | 0643176 | 3/1995 |
| EP | 0644299 | 3/1995 |
| EP | 0653524 | 5/1995 |
| EP | 0752356 | 1/1997 |
| EP | 0763633 | 3/1997 |
| EP | 0823513 | 2/1998 |
| EP | 0861947 | 9/1998 |
| EP | 1124020 | 8/2001 |
| EP | 1217135 | 6/2002 |
| EP | 1340861 | 9/2003 |
| EP | 1657369 | 5/2006 |
| EP | 1840282 | 10/2007 |
| EP | 2060684 | 5/2009 |
| EP | 2085526 | 8/2009 |
| ES | 1058139 | 11/2004 |
| ES | 2234760 | 7/2005 |
| GB | 1477494 | 6/1977 |
| GB | 2301157 | 11/1996 |
| JP | 1111933 | 4/1989 |
| JP | 2000213055 | 8/2000 |
| NZ | 336407 | 10/2000 |
| WO | 9010123 | 9/1990 |
| WO | 9641059 | 12/1996 |
| WO | 9832929 | 7/1998 |
| WO | 0214148 | 2/2002 |
| WO | 0240793 | 5/2002 |
| WO | 0240795 | 5/2002 |
| WO | 0240797 | 5/2002 |
| WO | 0244483 | 6/2002 |
| WO | 03000999 | 1/2003 |
| WO | 03003894 | 1/2003 |
| WO | 2006040138 | 4/2006 |
| WO | 2010005313 | 1/2010 |
| WO | 2010143964 | 12/2010 |

OTHER PUBLICATIONS

English language abstract of CN 201343774 (1 page).
English language abstract of CN 101845847 (1 page).
English language abstract of DE 69721722 (1 page).
English language abstract of DE 69710175 (1 page).
English language abstract of DE 69633014 (1 page).
English language abstract of DE 69426661 (1 page).
English language abstract of DE 60110280 (1 page).
English language abstract of JP 1111933 (1 page).
English language abstract of ES 2234760 (1 page).
English language abstract of DE 861981 (1 page).
English language abstract of DE 643176 (1 page).
English language abstract of DE 361635 (1 page).

TOILET WITH BALL VALVE MECHANISM AND SECONDARY AEROBIC CHAMBER

CROSS-REFERENCE TO RELATED APPLICATIONS

This application claims benefit to provisional patent application Ser. No. 61/524,120, filed 16 Aug. 2011, which is hereby incorporated by reference in its entirety.

BACKGROUND OF THE INVENTION

1. Field of the Invention

The present invention relates to a toilet; and more particularly relates to a toilet with a ball valve mechanism.

2. Brief Description of Related Art

Toilets in general have only one real purpose which is to act as the portal to move human waste from one place to another. This is typically done with some form of a hole into which the waste is deposited and then the area is rinsed clean. The transfer of waste is accomplished by natural flow or by mechanical action.

Typical toilets use a lot of water for the rinsing action, are noisy if they incorporate a motor to transfer or macerate the waste thereby consuming a significant amount of power. Typical in most Marine, RV or portable installations is the output of unpleasant odors.

SUMMARY OF THE INVENTION

According to some embodiments, the present invention may take the form of apparatus, including a toilet including a bowl, a rinse pump, a flexible self cleaning gasket, a bowl valve and a solenoid. The bowl may be configured with a receptacle to receive waste, with a secondary chamber, and with an opening formed in the receptacle to allow the waste to pass from the receptacle to the secondary chamber. The rinse pump may be configured to turn on to add a small amount of rinsing water for cleaning the bowl. The flexible self cleaning gasket may be configured around the opening formed in the receptacle. The bowl valve may be configured with a sealing part having a substantially rounded shape, configured to rotate to a closed position that creates a sealed effect between the sealing part and the flexible self cleaning gasket trapping the waste and rinsing water in the receptacle of the bowl and sealing odors in the secondary chamber, and configured to rotate to an open position that sweeps the sealing part to be swept across the flexible self cleaning gasket and allowing the waste to pass from the receptacle to the secondary chamber. The solenoid may be configured to rotate the bowl valve from the closed position to the open position, and vice versa.

According to some embodiments, the present invention may include one or more of the following features:

The toilet may include a pump, e.g., a diaphragm pump, configured to turn on during a flush cycle to pull air and/or waste from the secondary chamber creating a negative pressure environment so that when the bowl valve is activated there is substantially no odor escaping from the secondary chamber.

The diaphragm pump may be configured to periodically cycle to maintain an appropriate amount of air in the secondary chamber.

The diaphragm pump may be configured to be either manually operated or may take the form of a motor pump driven by various mechanical, electrical or other energy sources.

The diaphragm pump may be configured to cycle to remove the waste from the secondary chamber, and pull air from an upper check valve arranged in the secondary chamber as the bowl valve is sealed against the flexible self cleaning gasket.

The toilet may include an additional rinsing jet configured in the secondary chamber to assist in the movement, breakdown or transport of the waste in the secondary chamber.

The toilet may include a sealing ring configured to seal the secondary chamber to the underside of the receptacle of bowl by clamps.

The clamps may be configured to be opened in order to drop the secondary chamber down in order to replace the flexible self cleaning gasket.

The bowl valve may be configured to rotate about 90° clockwise to open in order to expose a curved part of the bowl valve and to rotate about 90° counter clockwise to close.

The toilet may include an additional rinse jet configured to rinse the curved part once the bowl valve is closed.

The solenoid may be configured as a snap-action solenoid that receives power from a power source that includes an electrical, air or water driven power source.

In effect, the toilet according to some embodiments of the present invention uses a nozzle to provide a more direct rinse spray pattern to better effectively rinse the bowl while using limited water. The quietness of the toilet is achieved by utilizing slower, quieter and lower power usage diaphragm pumps which act as to macerate and move the waste as opposed to a high speed centrifugal pump that is louder and uses more power. The secondary chamber that the waste drops into past the bowl valve is designed to promote the proliferation of aerobic bacteria which overtake the anaerobic bacteria which are associated with odor. This is done by periodically cycling the diaphragm pump to pull air through the upper one way check valve while it is emptying the chamber.

BRIEF DESCRIPTION OF THE DRAWING

The drawing includes the following Figures, not necessarily drawn to scale.

Figure 1:
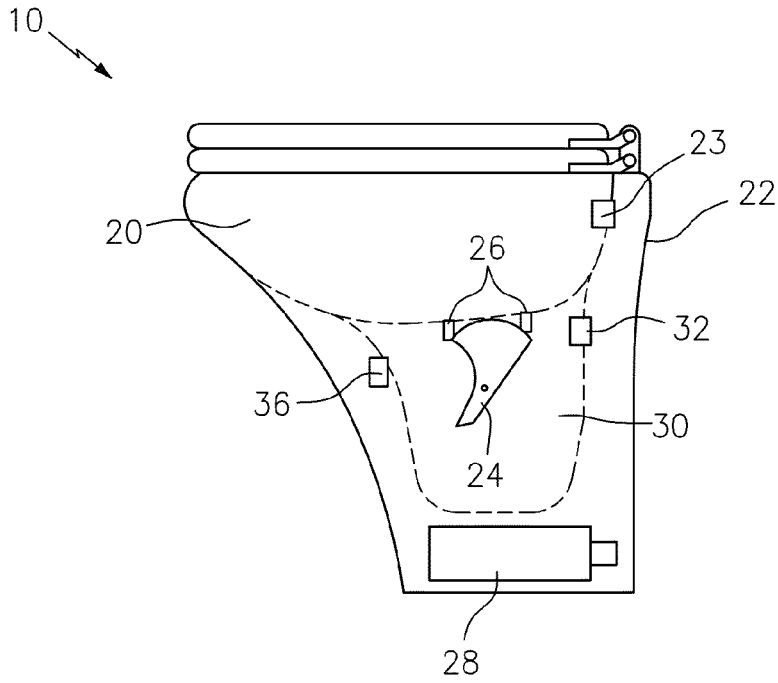
FIG. 1 is an illustration of a toilet as a side view, according to some embodiments of the present invention.
Figure 2:
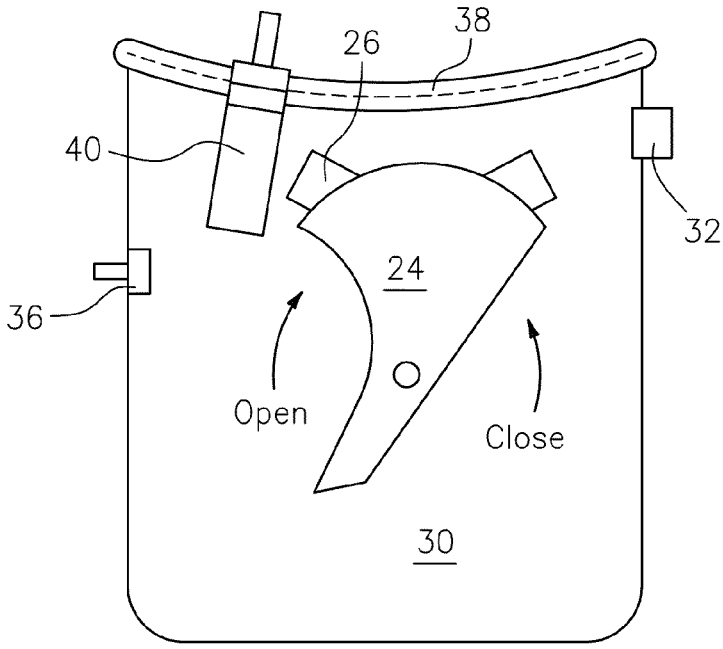
FIG. 2 is an illustration of a secondary chamber as a side view that forms part of the toilet shown in FIG. 1, according to some embodiments of the present invention.
Figure 3:
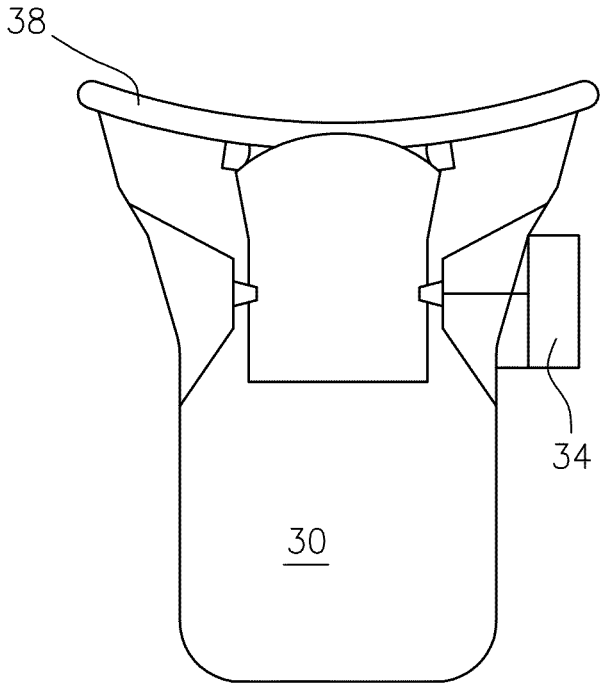
FIG. 3 is an illustration of the secondary chamber as a front view that forms part of the toilet shown in FIG. 1, according to some embodiments of the present invention.

In the following description of the exemplary embodiment, reference is made to the accompanying Figures in the drawing, which form a part hereof, and in which are shown by way of illustration of an embodiment in which the invention may be practiced. It is to be understood that other embodiments may be utilized, as structural and operational changes may be made without departing from the scope of the present invention.

DETAILED DESCRIPTION OF THE INVENTION

FIG. 1 shows apparatus according to some embodiments of the present invention in the form of a toilet generally indicated as 10.

The components of the toilet (10) include a bowl (20) for which the design has been optimized to direct the water in a way to effectively rinse the bowl (20) with a small amount of water. Along a rim of the bowl (20), a receptacle (22) may be configured for a nozzle rinse pump or jet (23) which accepts water from a pressurized source of raw or grey water. The toilet (10) may include a bowl valve (24) that has a rounded shape which when it is rotated from a closed position to an open position is swept across a flexible self cleaning gasket (26) that both wipes the bowl valve (24) clean and creates a sealed effect trapping water in the bowl (20). This small amount of water is used to wet the bowl (20) and act as an indicator that the seal is in good shape. During a flush cycle, a pump (28), e.g., a diaphragm pump, may be turned on momentarily to pull air and or waste from a secondary chamber (30) creating a negative pressure environment so that when the bowl valve (24) is activated there is substantially little or no possibility of odor escaping the secondary chamber (30). The rinse jet or pump (23) attached to the receptacle (22) may be configured to turn on momentarily to add a small amount of rinsing water cleaning the bowl (20). After the bowl valve (24) closes and is exposed to the wiping effect of the bowl seal or gasket (26), the toilet (10) is ready for the next use.

In the meantime, the flush diaphragm pump (28) is configured to cycle to remove the waste from the secondary chamber (30), pulling air from an upper check valve (32) as the bowl valve (24) is sealed against the bowl seal or gasket (26). The action adds air to the secondary chamber (30) to create the aerobic environment and continue discharging the waste in the secondary chamber (30). Periodically, the diaphragm pump (28) will cycle to maintain an appropriate amount of air in the secondary chamber (30). The rinse water from the rinse jet or pump (23) applied to the receptacle (22) may be, e.g., from either a solenoid/siphon break type valve that uses an existing pressurized water source or a discrete pump pressurizing raw water from any fresh, salt or grey source. The ball valve (24) may be actuated by a solenoid (34), e.g., a snap action solenoid (34), with the power source being electrical, air or water driven. The diaphragm discharge pump (28) can be either a manually operated version or a motor pump driven by various mechanical, electrical or other energy sources. The secondary chamber (30) may incorporate an additional rinsing jet (36) to assist in the movement, breakdown or transport of the material in the secondary chamber (30). The secondary chamber (30) may include a sealing ring (38) which seals the secondary chamber (30) to the underside of the bowl (20) by clamps (40). The seal (26) can be easily replaced by opening the clamps (40) and dropping the secondary chamber (30) down and the seal (26) slides into a channel. As the clamps (40) are tightened, the bowl valve (24) is lifted into position to seal on the seal (26). Other components of the toilet (10) may include, e.g., a soft close seat and lid, various ceramic or composite materials used in the construction of the bowl and secondary chamber.

The secondary chamber (30) may be coupled to the diaphragm pump (28) via a coupling (not shown). The secondary chamber (30) may be configured to receive and hold, e.g., at least three waste cycles before the diaphragm pump (28) removes the waste cycles from therein, although the scope of the invention is intended to be limited to any particular number of waste cycles. For example, embodiments are envisioned having fewer waste cycles that three, or more than three waste cycles.

The bowl valve (24) may be configured to rotate about 90° clockwise to open as shown in order to expose a curved part (24*a*) of the bowl valve (24), and also may be configured to rotate about 90° counter clockwise to close as shown. The additional rinse jet (36) may be used to rinse the curved part (24*a*) once the bowl valve (24) is closed.

By way of example, parts and components like the bowl (20), the rinse pump or jet (23), the flexible self cleaning gasket (26), the bowl valve (24), the diaphragm pump (28) and the solenoid (34), as well as other parts or components set forth above, are all individual elements that are known in the art, and the scope of the invention is not intended to be limited to any particular type or kind thereof either now known or later developed in the future.

Possible Application

The toilet (10) according to some embodiments of the present inventions has applications that may include the following: Marine, RV, portable toilets as an individual toilet or in a group, residential and commercial installations. Event trailers used at all manner of gatherings, hunting lodges, upflush toilet, basements, developing nations, latrines, remote rest stations and cabins.

The Scope of the Invention

It should be understood that, unless stated otherwise herein, any of the features, characteristics, alternatives or modifications described regarding a particular embodiment herein may also be applied, used, or incorporated with any other embodiment described herein. Also, the drawings herein are not drawn to scale.

Although the invention has been described and illustrated with respect to exemplary embodiments thereof, the foregoing and various other additions and omissions may be made therein and thereto without departing from the spirit and scope of the present invention.

What I claim is:

1. A toilet comprising:

a bowl configured with a receptacle to receive waste, with a secondary chamber, and with an opening formed in the receptacle to allow the waste to pass from the receptacle to the secondary chamber;

a rinse pump configured to turn on to add a small amount of rinsing water for cleaning the bowl;

a flexible self cleaning gasket configured around the opening formed in the receptacle;

a bowl valve configured with a sealing part having a substantially rounded shape, configured to rotate to a closed position that creates a sealed effect between the sealing part and the flexible self cleaning gasket trapping the waste and rinsing water in the receptacle of the bowl and sealing odors in the secondary chamber, and configured to rotate to an open position that sweeps the sealing part to be swept across the flexible self cleaning gasket and allowing the waste to pass from the receptacle to the secondary chamber; and a solenoid configured to rotate the bowl valve from the closed position to the open position, and vice versa.

2. A toilet according to claim 1, wherein the toilet comprises a pump, including a diaphragm pump, configured to turn on during a flush cycle to pull air and/or waste from the secondary chamber creating a negative pressure environment so that when the bowl valve is activated there is substantially no odor escaping from the secondary chamber.

3. A toilet according to claim 2, wherein the diaphragm pump is configured to periodically cycle to maintain an appropriate amount of air in the secondary chamber.

4. A toilet according to claim 2, wherein the diaphragm pump either is configured to be manually operated or takes the form of a motor pump driven by various mechanical, electrical or other energy sources.

5. A toilet according to claim 2, wherein the diaphragm pump is configured to cycle to remove the waste from the secondary chamber, and pull air from an upper check valve arranged in the secondary chamber as the bowl valve is sealed against the flexible self cleaning gasket.

6. A toilet according to claim 1, wherein the toilet comprises an additional rinsing jet configured in the secondary chamber to assist in the movement, breakdown or transport of the waste in the secondary chamber.

7. A toilet according to claim 1, wherein the toilet comprises a sealing ring configured to seal the secondary chamber to the underside of the receptacle of bowl by clamps.

8. A toilet according to claim 1, wherein the clamps are configured to be opened in order to drop the secondary chamber down in order to replace the flexible self cleaning gasket.

9. A toilet according to claim 1, wherein the bowl valve is configured to rotate about 90° clockwise to open in order to expose a curved part of the bowl valve and to rotate about 90° counter clockwise to close.

10. A toilet according to claim 9, wherein the toilet comprises an additional rinse jet configured to rinse the curved part once the bowl valve is closed.

11. A toilet according to claim 1, wherein the solenoid is configured as a snap-action solenoid that receives power from a power source that includes an electrical, air or water driven power source.

* * * * *